US006551501B1

(12) United States Patent
Whitehurst et al.

(10) Patent No.: US 6,551,501 B1
(45) Date of Patent: Apr. 22, 2003

(54) COMBINED PROCESS FOR IMPROVED HYDROTREATING OF DIESEL FUELS

(75) Inventors: Darrell Duayne Whitehurst, Titusville, NJ (US); Michael Brorson, Charlottenlund (DK); Kim Grøn Knudsen, Virum (DK); Per Zeuthen, Birkerød (DK); Barry H. Cooper, Charlottenlund (DK)

(73) Assignee: Haldor Topsoe A/S, Lyngby (DK)

( * ) Notice: Subject to any disclaimer, the term of this patent is extended or adjusted under 35 U.S.C. 154(b) by 58 days.

(21) Appl. No.: 09/585,313

(22) Filed: Jun. 1, 2000

(30) Foreign Application Priority Data

Jun. 2, 1999 (DK) ..... 1999 00776

(51) Int. Cl.[7] ..... C10G 45/00; C10L 1/04
(52) U.S. Cl. ..... 208/211; 208/15; 208/254 R
(58) Field of Search ..... 208/15, 211, 254 R

(56) References Cited

U.S. PATENT DOCUMENTS

| | | | | |
|---|---|---|---|---|
| 3,962,364 A | | 6/1976 | Young | 260/671 |
| 4,044,065 A | | 8/1977 | Butter et al. | 260/677 |
| 4,269,694 A | | 5/1981 | Holland et al. | |
| 4,344,841 A | * | 8/1982 | Johnson et al. | 208/211 |
| 4,454,241 A | | 6/1984 | Pine et al. | 502/68 |
| 5,454,933 A | | 10/1995 | Savage et al. | 208/212 |
| 5,481,057 A | | 1/1996 | Bell et al. | 585/722 |
| 6,248,230 B1 | * | 6/2001 | Min et al. | 208/213 |

FOREIGN PATENT DOCUMENTS

EP 0215 496 A2 3/1987

OTHER PUBLICATIONS

Jean P. Teas, "Graphic Analysis of Resin Solubilities", vol. 40, No. 516, Jan. 1968, pp. 19–25.
D. Duane Whitehurst, et al. "Present State of the Art and Future Challenges in the Hydrodesulfurization of Polyaromatic Sulfur Compounds", *Advances in Catalysis,* vol. 42; pp. 345–471.
Michael J. Girgis, et al. "Reactivities, Reaction Networks, and Kinetics in High Pressure Catalytic Hydroprocessing", *Ind. Eng. Chem. Res.,* vol. 30, No. 9, 1991; pp. 2021–2058.
P.B. Weisz, et al. "Superactive Crystalline Aluminosilicate Hydrocarbon Catalsts", *Journal of Catalysis 4* (1965); pp. 527–529.

* cited by examiner

*Primary Examiner*—Thuan D. Dang
(74) *Attorney, Agent, or Firm*—Dickstein Shapiro Morin & Oshinsky, LLP

(57) ABSTRACT

Described herein is a combined process for improved hydrotreating of diesel fuels, in which the feed to be hydrotreated is pretreated with a selective adsorbent prior to the hydrotreating step to remove polar materials, especially nitrogen containing compounds (N-compounds). The selective adsorption process can employ either liquid or solid adsorbents. After contact of the adsorbent with the diesel fuel feed, the adsorbent containing undesired polar compounds is separated from the diesel fuel. The separated adsorbent is then subjected to a two step procedure for regeneration.

12 Claims, 10 Drawing Sheets

COMBINED PROCESS FOR IMPROVED HYDROTREATING OF DIESEL FUELS

FIELD OF INVENTION

The present invention relates to hydrotreating of diesel fuels and in particular to improvement of those processes in a staged process.

BACKGROUND

The need to produce extremely clean transportation fuels is continually increasing. Future standards are being set, which cannot be achieved with existing process equipment. Although improved commericial catalysts are available, they are not sufficiently active to meet the increasingly more strict requirements for high quality commercial fuels, and thus modifications of process equipment are also necessary. Such changes in process equipment will be expensive and there is a need to identify novel processes to meet these requirements.

DETAILED DESCRIPTION

Overall Process Description

It is in the context of the above problems that the present invention was conceived. When the sulphur level must be lowered to less than 500 ppm sulphur, the conversions that are required involve desulphurization of highly substituted dibenzothiophenes, especially those in which the substituents are present on the aromatic rings adjacent to the heterocyclic sulphur atom. We will refer to such compounds as refractory sulphur compounds (RS-compounds). A typical example of such a compound is 4,6-dimethyldibenzothiophene (46 DMDBT). We have found that the conversion of the most refractory sulphur (RS) compounds (such as 46 DMDBT) in diesel fuels is made even more difficult by the presence of certain other components found in normal feeds to diesel hydrotreaters. Such compounds are referred to as inhibitors for hydrodesulphurization (HDS).

Figure 2:
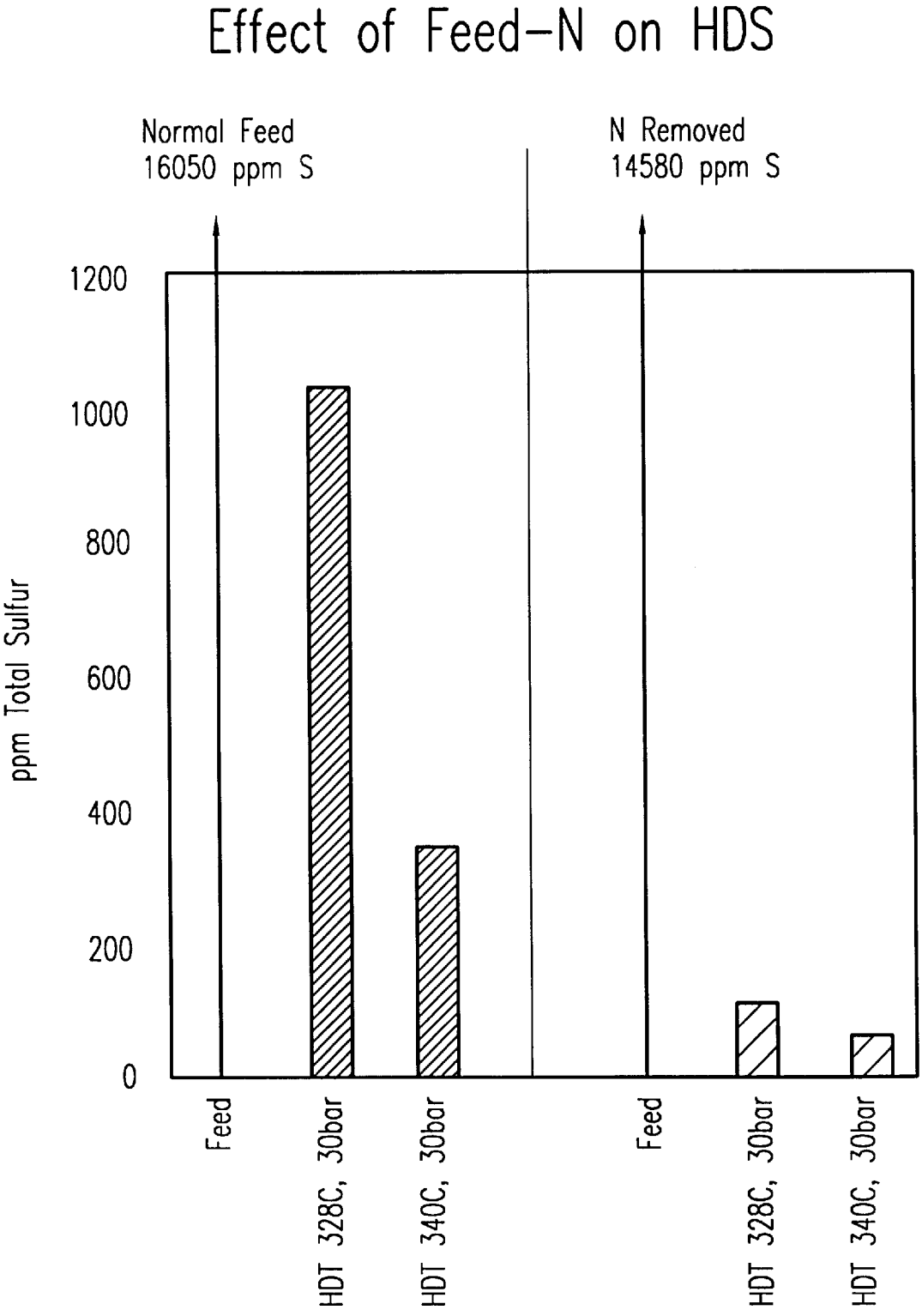
Figure 3:
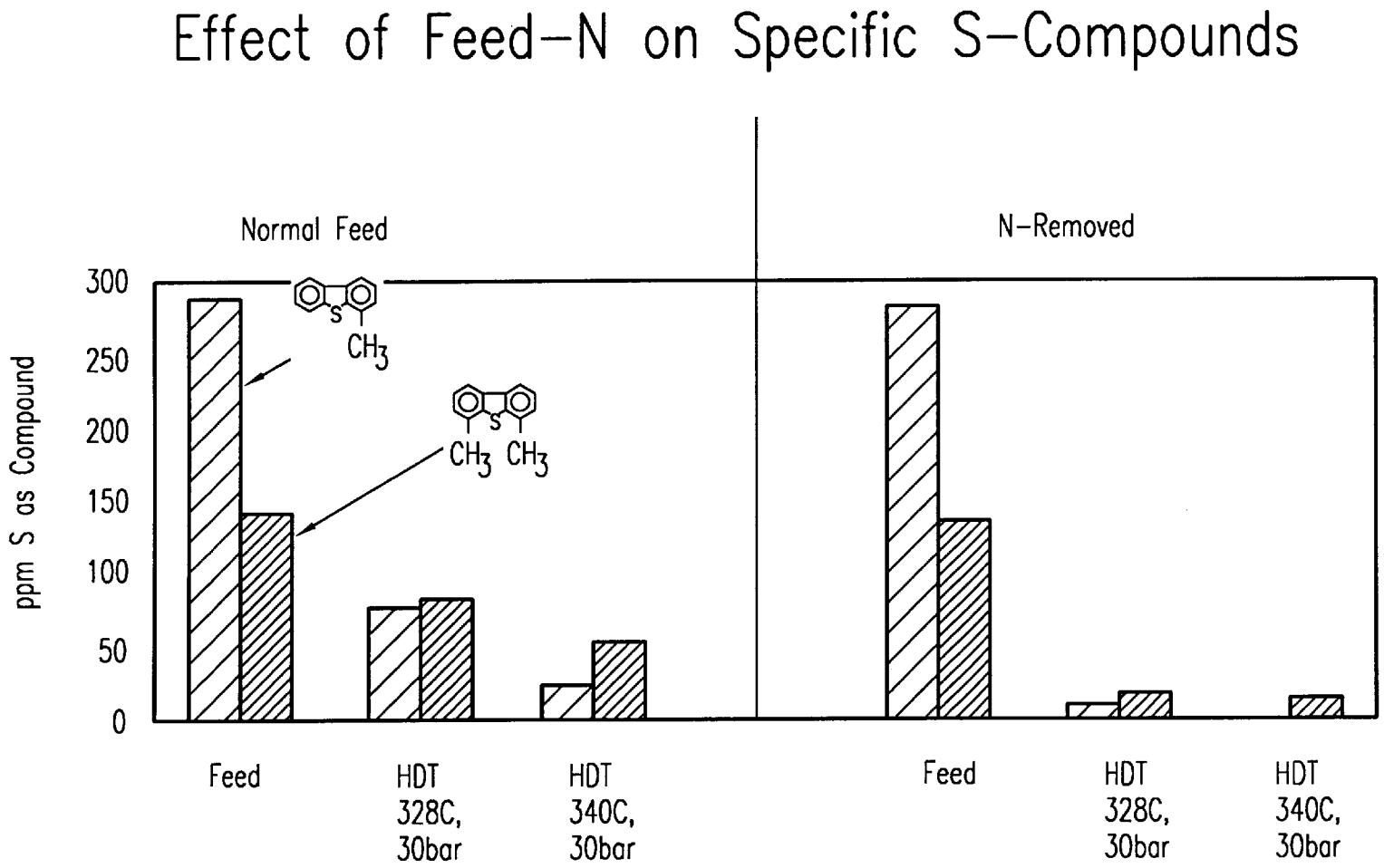

We have discovered that if such inhibitors are selectively removed from the feed and the feed containing less inhibitors is hydrotreated under typical commercial conditions used in today's refineries, then the RS-compounds can be readily removed by hydrotreating using conventional catalyst loadings and process conditions. The degree to which the inhibitors are removed will depend on the particular adsorbent used and the cost of the removal process. In many instances, it is not necessary to remove all of the inhibitors to experience the benefits of our combined process. For ease of discussion, we will refer to diesel fuels which have been contacted with adsorbents for the inhibitors as "inhibitor free" diesel fuels, however, we do not mean to imply that 100% of the inhibitors have been removed. FIGS. 2 and 3 and Example 1 illustrate this point.

Hydrotreating Process

Figure 1:
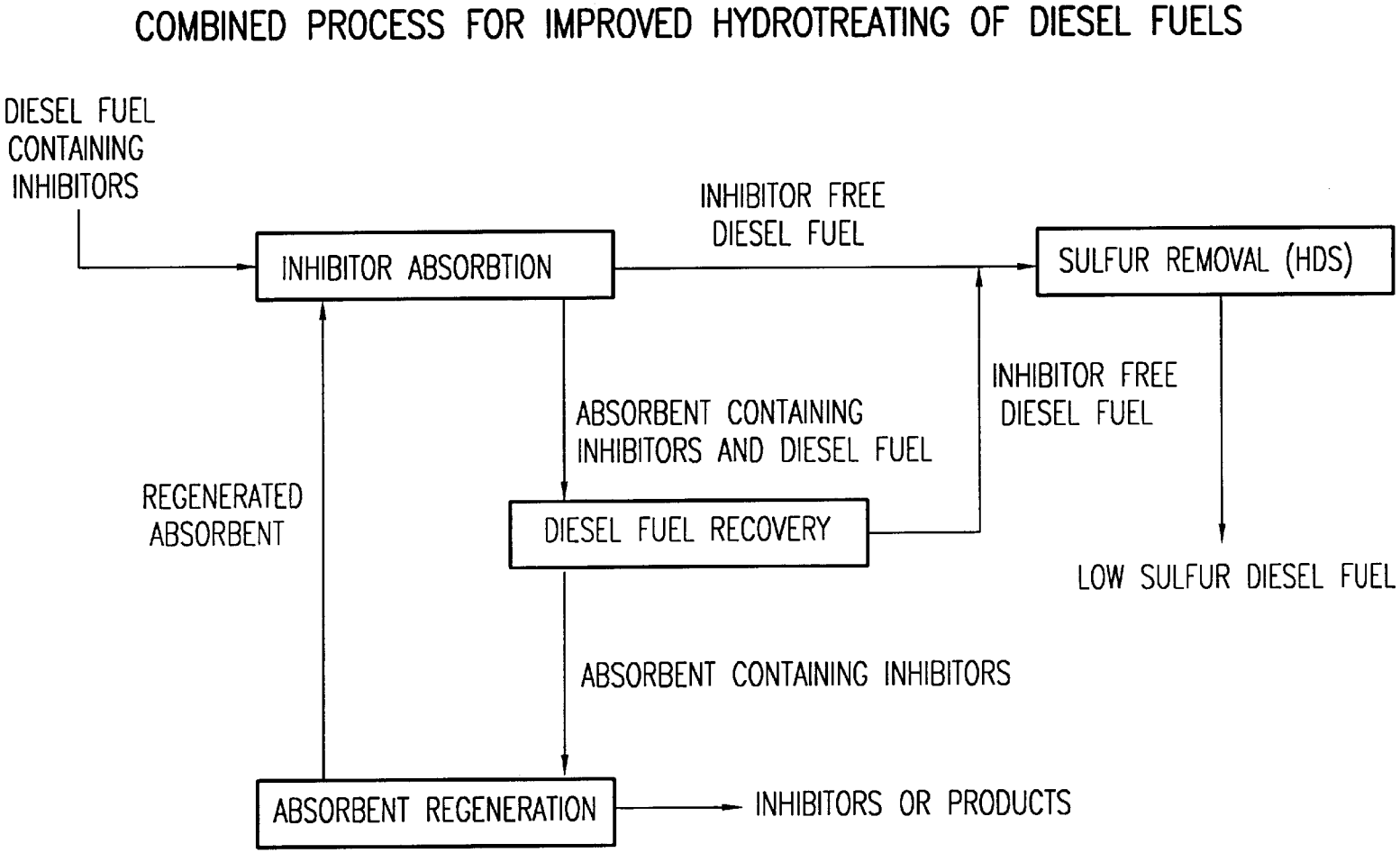

The hydrotreating step of the combined process scheme of this invention, shown in FIG. 1, can be any conventional hydrotreating process. This includes fixed or ebulated bed operations at conventional operating conditions such as temperatures in the range of 250° C. to 450° C., preferably 300° C. to 380° C. Pressures are also conventional such as 20–60 atm of hydrogen, and preferably below 40 atm of hydrogen. Higher temperatures and pressures will also provide the benefits of the present invention, however, lower pressures and temperatures are preferred to avoid yield losses of valuable diesel fuels and to avoid the need for construction of new process equipment in order to achieve extremely strict sulphur standards such as less than 300 ppm sulphur or even more strict sulphur standards of less than 50 ppm sulphur.

Catalysts used in the hydrotreating step are preferably those employed conventionally, such as mixed cobalt and/or nickel and molybdenum sulphides supported on alumina and mixed nickel and tungsten sulphides supported on alumina or silica. The combined process of this invention will also benefit newly developed catalysts such as those containing ruthenium sulfide and catalysts using novel supports such as silica-aluminas, carbons or other materials. For details on the state of the art in conventional hydrotreating processes, we refer to "Hydrotreating Catalysis—Science and Technology", by H. Topsøe, B.S. Clausen and F. E. Massoth, Springer-Verlag Publishers, Heidelberg, 1996.

Inhibitor Removal Processes

It is possible to envision many ways of removing materials, which inhibit the hydrotreating process, especially the hydrodesulphurization of RS-compounds. However, the removal of inhibitors should be done in a practical way if this principle is to be realized commercially. The method used for inhibitor removal should be highly selective for only the inhibitors and should not remove the valuable components of the diesel fuel or other non-inhibiting components of the diesel fuel. An alternative process would be to selectively remove the RS-compounds as described in U.S. Pat. No. 5,454,933. However, in that patent the yield of diesel fuel was not specified, and in attempting to duplicate this patent, we have observed that the adsorbent carbon, though showing some selectivity for RS-compounds, has a high capacity for all diesel fuel components. When one attempts to recover the valuable diesel fuel components, the RS-compounds are also released, as the strength of adsorption is not high. Thus, it may be possible to concentrate the RS-compounds, but not remove them specifically. There are many different classes of materials that can inhibit the HDS of RS-compounds.

It is well known that certain basic compounds such as quinolines and acridines inhibit HDS reactions (see H. Topsøe, B. S. Clausen and F. E. Massoth, "Hydrotreating Catalysis—Science and Technology", Springer-Verlag publishers, Berlin 1996; M. J. Girgis and B. C. Gates, Ind. Eng. Chem. Res., pp. 2021–2058, Vol. 30 No. 9, 1991; D. D. Whitehurst, T. Isoda and I. Mochida, Advances in Catalysis, pp. 345–471, Vol. 42, 1998; and references therein). However, any compound that will compete with RS-compounds for adsorption on the catalytic site will inhibit the HDS of the RS-compound. Thus, in addition to basic compounds, other strongly adsorbing species in the diesel fuel that is to be hydrotreated will lower the rate of removal of sulphur from the diesel fuel. We have found that such inhibitors are all highly polar materials that may be selectively removed from the hydrocarbons and RS-compounds by various adsorbents. By polar compounds we mean classical basic compounds such as were described above, including their benzo-analogs. These may be identified in diesel fuels by titration with strong acids in non-aqueous media. Other inhibitors include acidic nitrogen species, such as carbazoles, indoles and their benzo-analogs. Such acidic N-compounds can be identified by titration with strong bases in non-aqueous media. Still other inhibitors include amphoteric compounds such as hydroxyquinolines, and still other neutral compounds containing more than one nitrogen in an aromatic ring system or compounds which contain both oxygen and nitrogen in the same molecule. Further, inhibitors need not contain nitrogen, but may e.g. be composed of highly polar oxygen containing species.

Thus, it is possible to devise adsorption processes, which will selectively remove certain chemical classes of inhibitors or selectively remove essentially all inhibitor molecules by virtue of their polar nature. We have devised several different means to achieve selective inhibitor removal from diesel fuels using either their chemical properties or their polar properties. The particular method that is preferred will depend on the particular situation and the specific diesel fuel that is to be processed. However, the most preferred general method for inhibitor removal is based on their polar nature. The following text describes the various methods we have devised for use in the combined process of this invention.

Liquid Adsorbent Processes

In the present invention, our approach is to selectively remove the inhibitors for RS-compound conversion and then selectively desulphurize the inhibitor free feed in conventional HDS operations. We have found that only certain adsorbents have the selectivity desired.

Liquid adsorbents can be identified using their solvent parameters, $f_d$, $f_p$ and $f_h$, as defined by Teas [see J. P. Teas, "Graphic Analysis of Resin Solubilities", J. Paint Technology 19, 40 (1968)]. To define the useful range of solubility parameters, it is customary to construct a triangular diagram and identify an area within the diagram in which the desired results are obtained. This effective area reflects the solubility characteristics of desirable solvents in terms of their solvent parameters, $f_d$, $f_p$ and $f_h$, which reflect the solvents' dispersive, hydrogen bonding and polarity characteristics, respectively.

Figure 4:
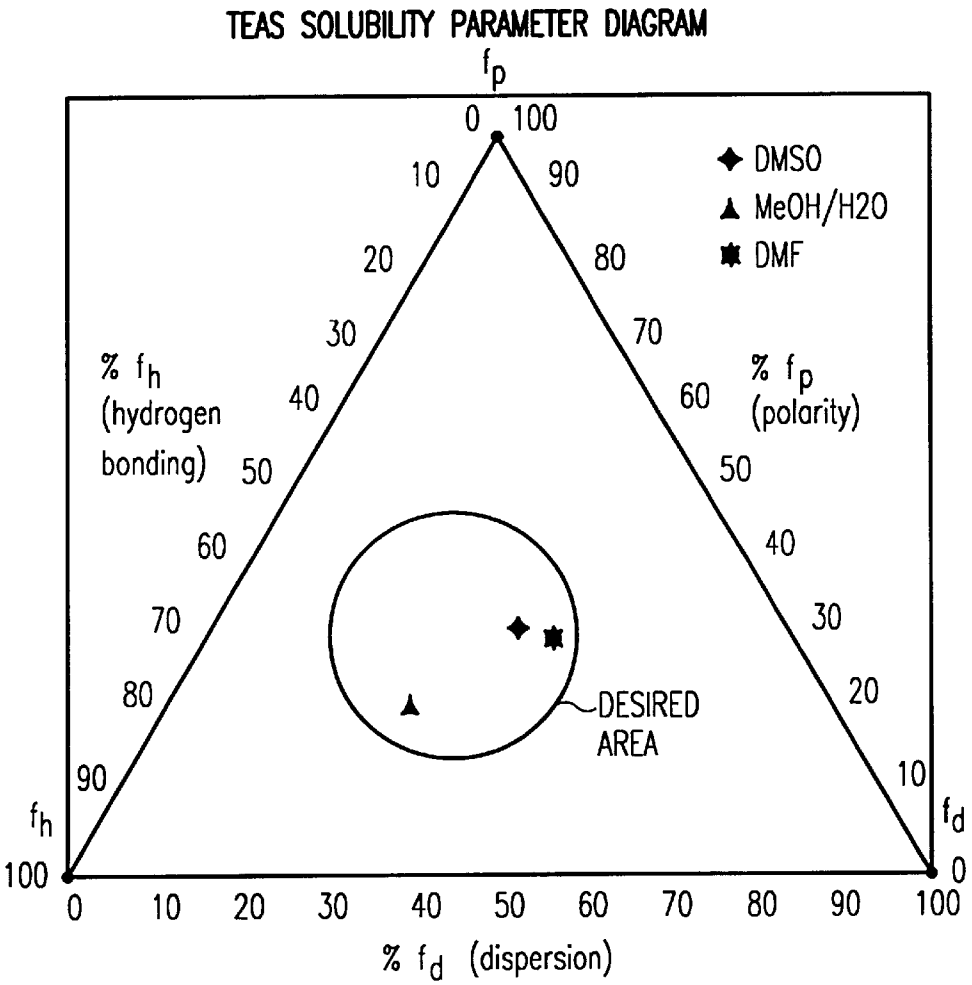

FIG. 4 shows the region of desired properties in the present invention. Solvents that have solubility parameters that fall within the desired range shown in FIG. 4 will be able to selectively remove the inhibitors, while rejecting the valuable diesel fuel components. In this example, dimethylformamide, dimethylsulphoxide and methanol containing 25% water are shown to fall within the desired area for our process.

Figure 5:
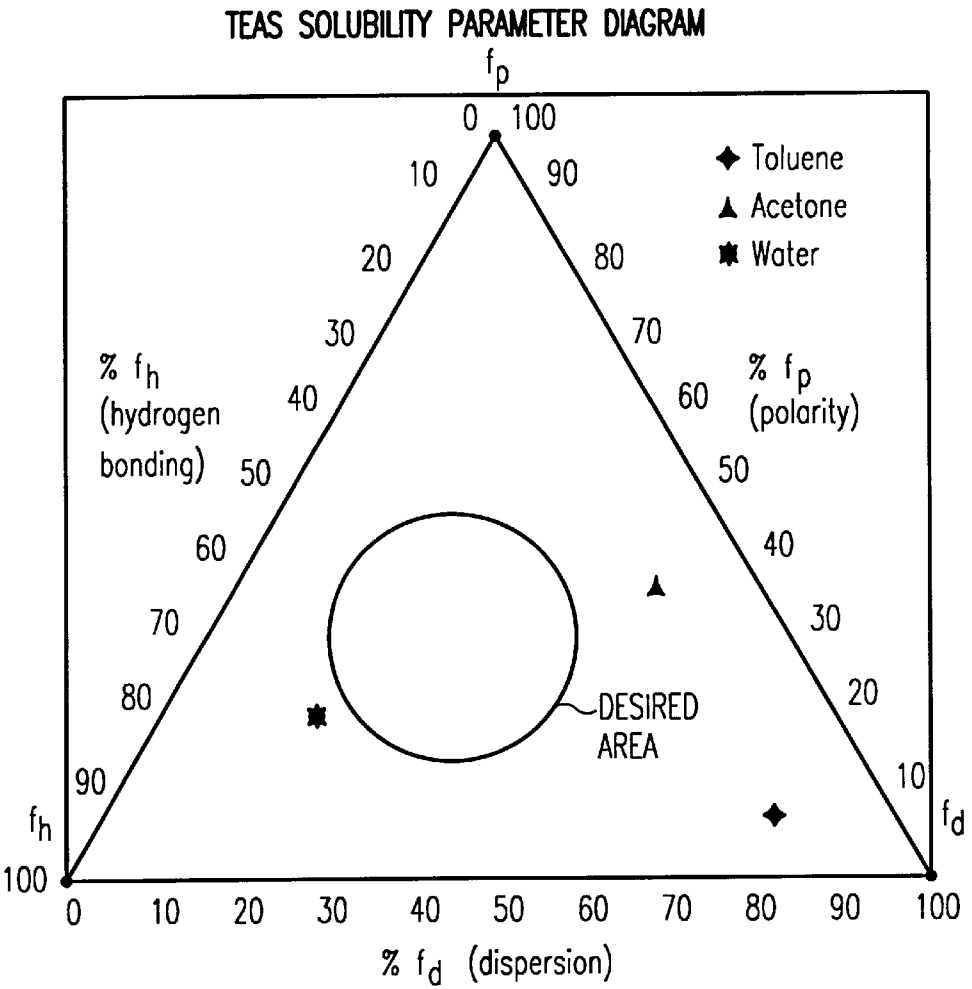

In FIG. 5, examples of solvents that are not suitable for our process are shown. In this case water alone is a poor solvent for the inhibitors, while toluene and acetone are not selective for the inhibitors as they are good solvents for diesel fuel and do not form a separate phase.

Figure 6:
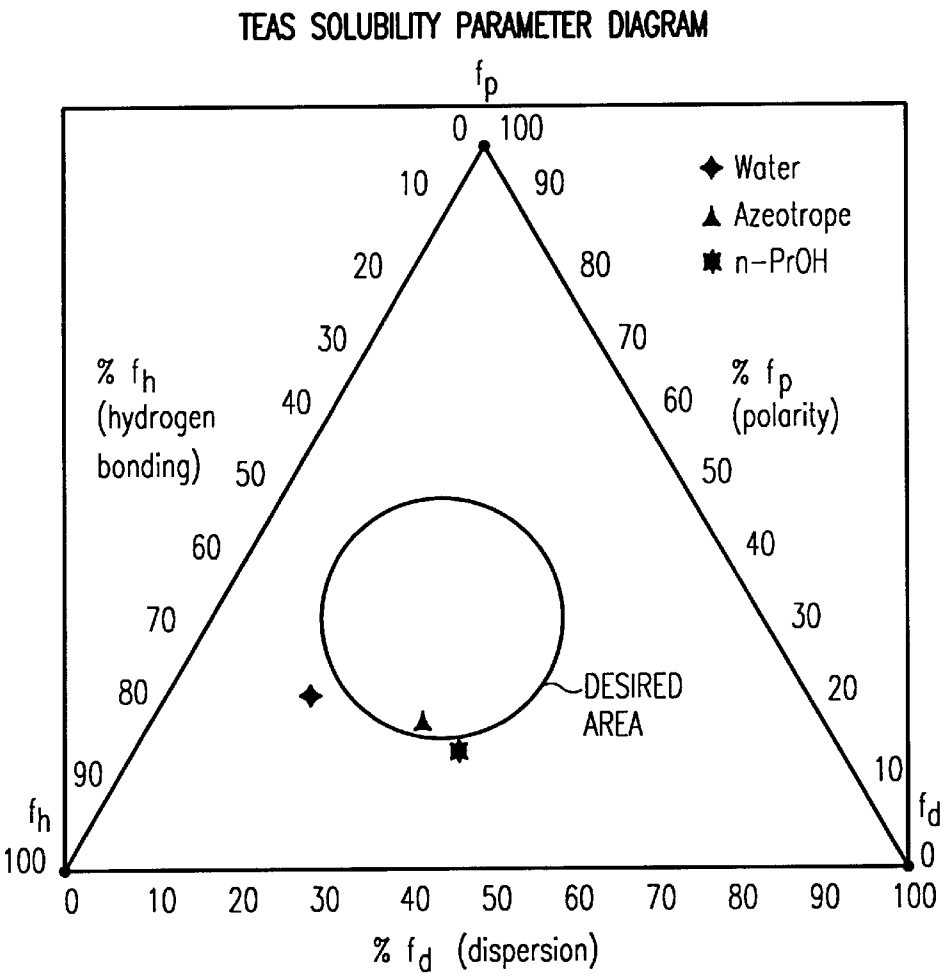

A further example of how two non-useful solvents may be combined in specific proportions to make a mixture, which has the correct solvent properties, is shown in FIG. 6. In this example, n-propanol is a borderline adsorbent as it is too strong a solvent for the desired inhibitor free fuel and water is too poor a solvent for the inhibitors. A mixture of the two falls within our desired range of solvent parameters.

A further advantage of some mixtures is that some specific combinations form azeotropes (constant boiling mixtures), which have the desired solvent parameters. This is the case shown in FIG. 6, where the azeotrope of water and n-propanol consists of 71.8% n-propanol and 28.2% water. This azeotrope boils at a lower temperature than either component and would thus retain constant composition in the distillation step used for solvent recovery.

Another important property of the solvent used to remove inhibitors is the density of the liquid. To operate a successful separation process, the density of the solvent should have a lower or higher specific gravity than the diesel fuel being treated. The difference between the specific gravity of the diesel fuel and the solvent should be at least 0.02 specific gravity units, and preferably more than this value.

To select a pure solvent or mixture, which has the correct solubility parameters for use in our process, one only needs to find the solvent parameters of the solvent or components of the mixture (from the literature or by experimental determination) and plot them on a triangular diagram similar to the one shown in FIG. 4. If the plot of the solubility parameters falls within the desired area of FIG. 4 then material will be useful for the process of this invention. If a mixed solvent is to be used, the mixed components should constitute a single phase in order to effectively extract the inhibitors from the diesel fuel.

To recover the solvent for reuse, distillation or, in some instances, a simple flash process can separate the solvent from the dissolved inhibitors. The isolated inhibitors may be disposed of by burning or in some cases they may serve as sources of chemicals.

Figure 7:
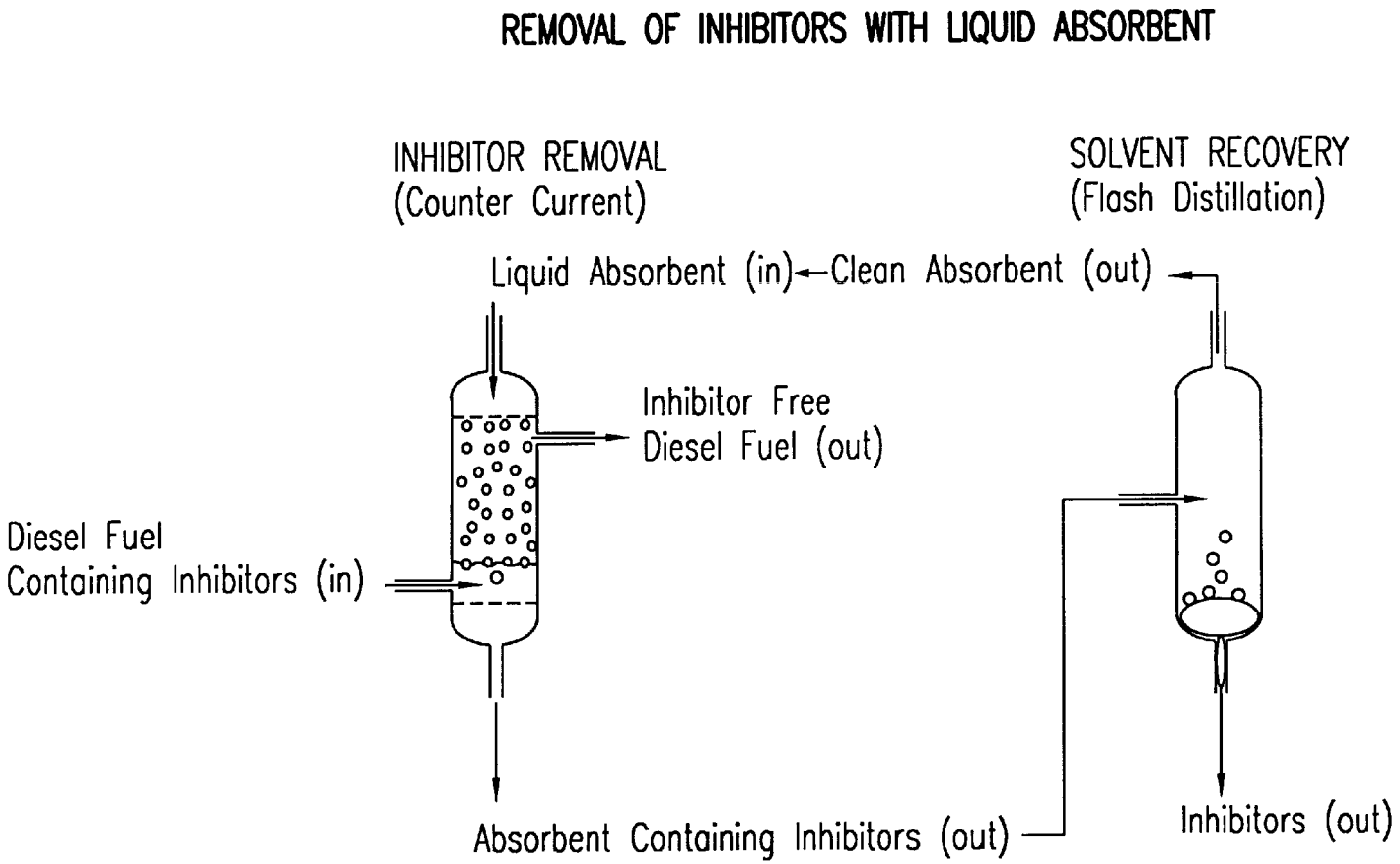

The process used for removing inhibitors with a liquid adsorbent can be any conventional process used for liquid-liquid extraction such as columnar counter current flow, stirred tank, hydroclone, etc. It may also be staged to increase the efficiency or it may be a single contact process, depending on the degree of separation desired. An illustration of this stage of our invention for selectively removing inhibitors with liquid adsorbents is given in FIG. 7. The schematic diagram illustrated in FIG. 7 represents a columnar countercurrent flow process. This illustration is only one example of a process that can be used to selectively remove the inhibitors prior to hydrotreating, but should-suffice to instruct anyone skilled in the art as to how to conduct such a process.

The range of conditions, which may be used in this extraction process, is quite broad and will depend on the particular solvents used and hydrotreating feeds that are being treated. Ambient conditions are preferred, but in some cases the efficiency of inhibitor removal or the density difference between the solvent and the diesel fuel may be optimized by raising or lowering the temperature. However, the temperature should not be higher than the boiling point of either the diesel fuel or the extraction solvent, and the temperature should not be lower than the freezing or pour point of the diesel fuel or extraction solvent. For ease of extraction solvent recovery, the boiling point of the extraction solvent should be considerably different from the diesel fuel boiling range, and preferably the solvent should have a boiling point lower than the lowest boiling component of the diesel fuel, or the lowest boiling inhibitor in the diesel fuel.

Solid Adsorbent Processes

Figure 8:
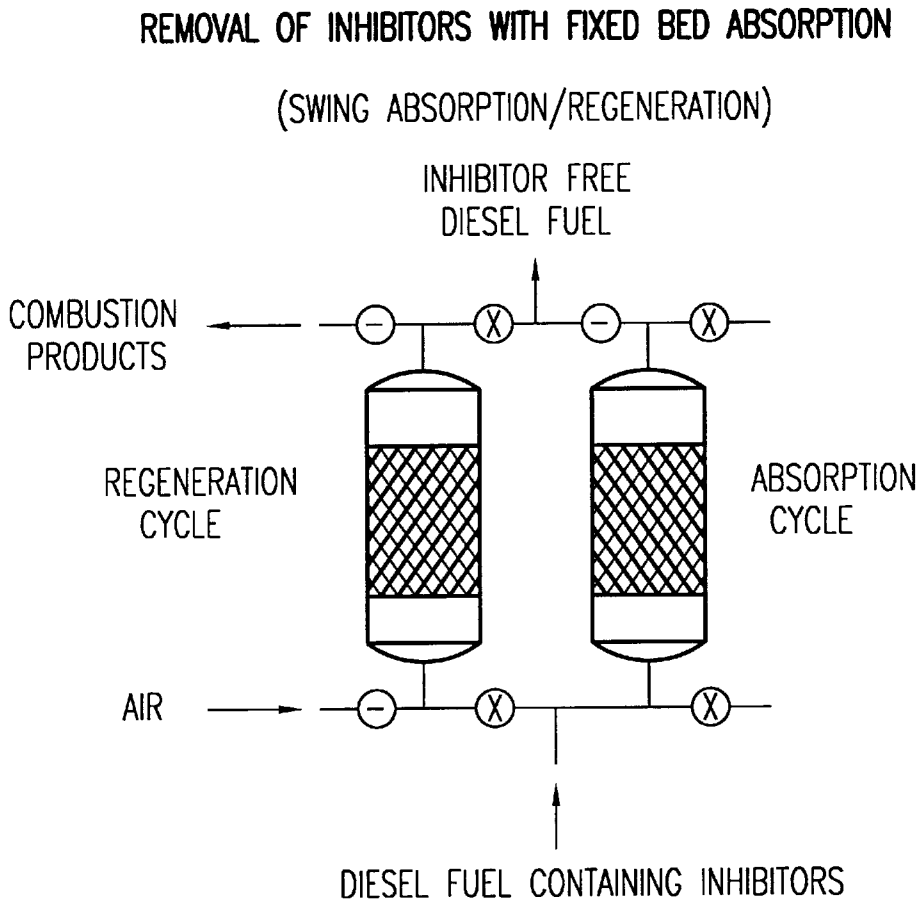
Figure 9:
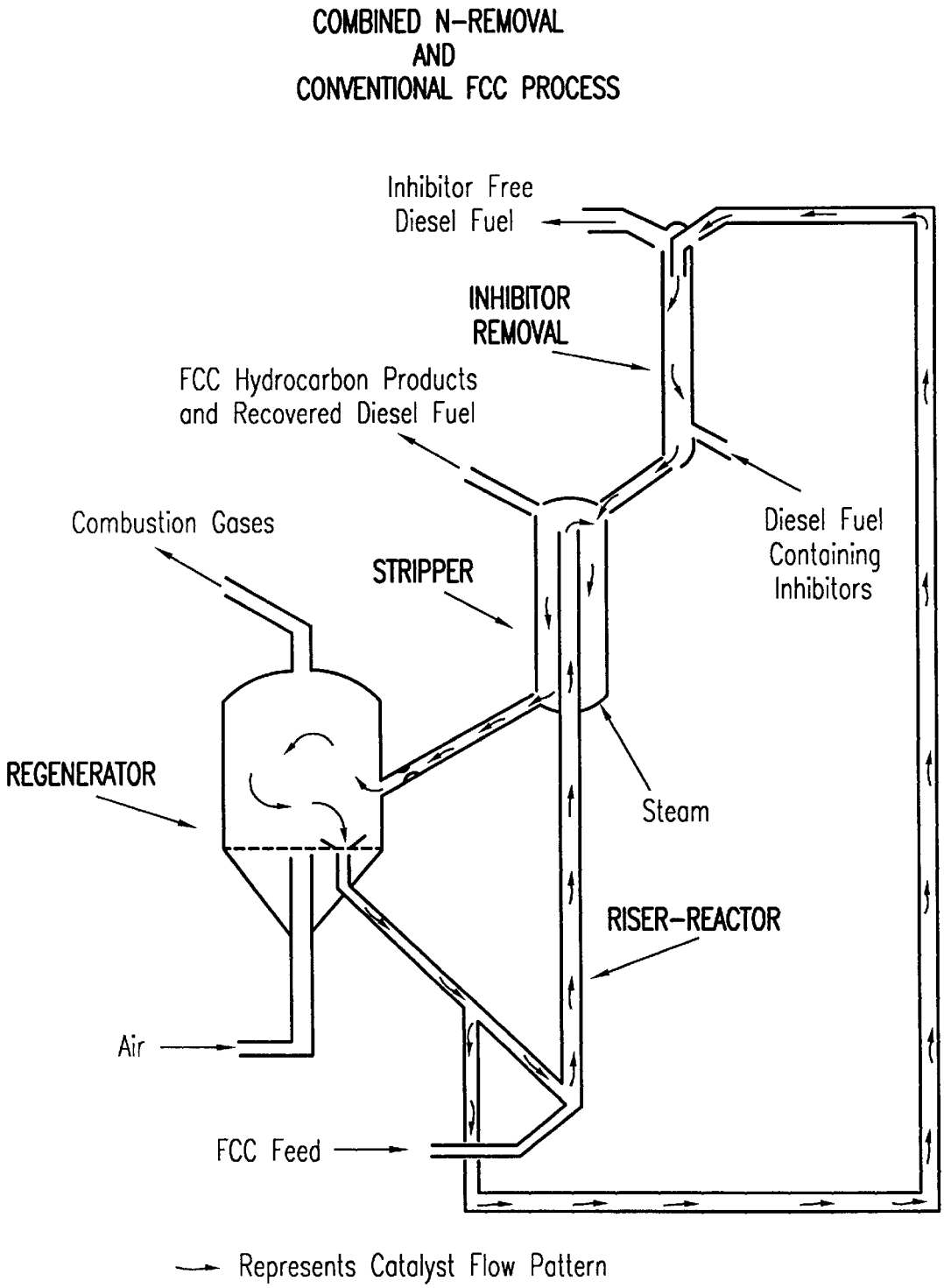

Another version of the present invention is to use a solid adsorbent in the inhibitor adsorption step. In this mode, many process variations are possible. The adsorption process may be conducted in a fixed bed operation or in moving beds, such as fluidized beds, ebulated beds, or simple moving beds. FIGS. 8 and 9 illustrate two examples of such processes. For all cases in which solid adsorbents are used, three integrated steps are needed for the overall process. Firstly, the solid adsorbent is contacted with the diesel fuel to remove inhibitors. Secondly, the solid is separated from the physically adsorbed inhibitor free fuel. Thirdly, the solid adsorbent, containing strongly held inhibitors is regenerated to provide inhibitor free adsorbent, which is reused.

In FIG. 8 two fixed beds are shown, in which one is in the adsorption mode, while the other is in the regeneration mode. The inhibitor free fuel is predominantly separated from the solid adsorbent by merely passing the diesel fuel through the fixed bed of adsorbent. However, a small amount of inhibitor free fuel is retained on the adsorbent at the end of the adsorption cycle, and this inhibitor free fuel is recovered prior to the regeneration step. Inhibitor free recovery is achieved by a stripping operation with a hot gas such as steam, hydrogen, refinery gaseous fuel, or other refinery gases produced as byproducts from another refinery process. The stripping operation can also be conducted with a light liquid, such as a C4–C7 hydrocarbon, but this stripping liquid should then be recovered with some stripping gas, prior to the adsorbent regeneration.

In this mode of inhibitor adsorption, the diesel fuel constitutes a liquid phase. The preferred temperature range for this mode of operation is from ambient to slightly below the initial boiling point of the diesel fuel being treated. This temperature range is generally between 15° C. to 300° C., but could also be conducted at sub-ambient temperatures if desired. The preferred range is from 20° C. to 200° C.

The adsorption cycle length is determined by the capacity of the adsorbent to remove the inhibitors from the diesel fuel feed. This is generally determined by analysis of the inhibitor free fuel for N-compound content. The preferred level of nitrogen in the treated inhibitor free fuel is generally below 200 ppm, and, more preferred, the level should be below 100 ppm, or even more preferred less than 20 ppm. At this level of nitrogen in the inhibitor free fuel, the subsequent hydrodesulphurization (HDS) is quite facile, and levels of sulphur in the product of less than 20 ppm can be achieved under mild conventional process conditions including lower pressures such as 30 atm of hydrogen as will be shown in the examples.

In another embodiment of this invention, the adsorption step can be conducted at elevated temperatures, where the diesel fuel is in the vapor phase. This temperature should be high enough for the diesel fuel to be in the vapor phase, but low enough for the cracking of the valuable diesel fuel not to occur. The temperature should also be low enough such that inhibitors are adsorbed by the solid adsorbent and are not released back into the inhibitor free fuel stream. In this mode of operation, the temperature range is generally from 300° C. to 450° C., and the preferred temperature range is from 350° C. to 400° C. When operating in this mode, the inhibitor free fuel is not substantially adsorbed by the solid adsorbent, and the stripping operation may in some instances not be necessary. The regeneration of the adsorbent is conducted as described above, when the adsorbent's capacity for removing the inhibitors has been reached. In this mode, the level of nitrogen in the effluent, inhibitor free fuel, again determines the capacity of the adsorbent to remove inhibitors. As described above, the level of nitrogen in the effluent is preferably below 200 ppm and even more preferred below 20 ppm.

In the regeneration step, it is preferable to restore the solid adsorbent's capacity, so that it may be recycled back to the adsorption zone and reused. Such regeneration can be either oxidative, i.e. by burning in a fixed bed operation, or reductive. In some cases it may be desirable to heat exchange the regenerated hot solid adsorbent, either directly or indirectly to recover the heat from the combusted polar compounds and/or to cool the adsorbent to the desired temperature for the adsorption zone. For hydrogenative regeneration, the inhibitors adsorbed on the adsorbent may be removed by high temperature contact with a gas containing molecular hydrogen, such as pure hydrogen or a refinery off gas containing a substantial portion of molecular hydrogen. This contact with hydrogen can be done at atmospheric or elevated pressures, but it is essential that the temperature be above 400° C. These regeneration procedures should be conducted at temperatures, which do not lower the surface area of the solid adsorbent, but substantially remove all of the inhibitors as gaseous products. The preferred temperature range for these regeneration steps is from 400° C. to 1000° C., and even more preferred, between 500° C. to 700° C. In some instances, the solid adsorbent may contain catalytic additives, which enhance the regeneration process. For example, in oxidative regenerations, oxidation catalysts such as calcium, magnesium, iron, potassium or sodium may be added, and in such instances, the preferred combustion temperature is 350° C. to 500° C. Hydrogenative regenerations may be enhanced by hydrogenation catalysis, such as nickel, iron, platinum, palladium, or other group VIII metals.

Other embodiments of this invention include inhibitor removal steps, in which the solid adsorbent is continuously circulated between the adsorption step in one vessel and the regeneration step in a separate vessel. Such processes include moving beds, ebulated beds, hydroclones, fluidized beds, etc. with external regeneration. These moving bed processes can be stand-alone operations or can be integrated with existing refinery equipment. In one preferred embodiment of this invention, the inhibitor removal step is integrated with an existing FCC operation in the refinery. In this embodiment, the adsorbent comprises the steady state, or equilibrium, FCC catalyst. FIG. 9 illustrates one example of this type of integrated process. As can be seen in the figure, the equilibrium catalyst is taken out as a side stream just after regeneration and is then contacted with the diesel fuel feed that contains inhibitors. The inhibitor free fuel is separated from the FCC catalyst adsorbent and then hydrotreated to remove sulphur contaminants as described above. The FCC adsorbent, containing inhibitors and some physically adsorbed inhibitor free fuel, is returned to the FCC operation in the stripper zone, where the inhibitor free fuel is recovered as part of the FCC product stream, and the inhibitors are retained by the FCC adsorbent. The FCC adsorbent is admixed with FCC catalyst containing coke produced in the FCC process and both are regenerated by combustion in the FCC regenerator. In such an integrated process, the relative amounts of equilibrium catalyst that are taken for the inhibitor adsorption process and returned to the FCC cracking process are determined by the content of inhibitors in the diesel fuel feed and the capacity of the equilibrium catalyst to remove-those inhibitors.

As the regenerated FCC catalyst often exits the regenerator at temperatures in excess of 900° C., it is sometimes desirable to cool the adsorbent FCC catalyst stream before the adsorption step in order to avoid cracking of the diesel fuel. This can be accomplished by either direct heat exchange with steam or refinery gas or by indirect heat exchange with water which produces steam for refinery heat or power generation. The degree of temperature reduction will depend on which mode of operation is employed in the adsorption step as described above.

Figure 10:
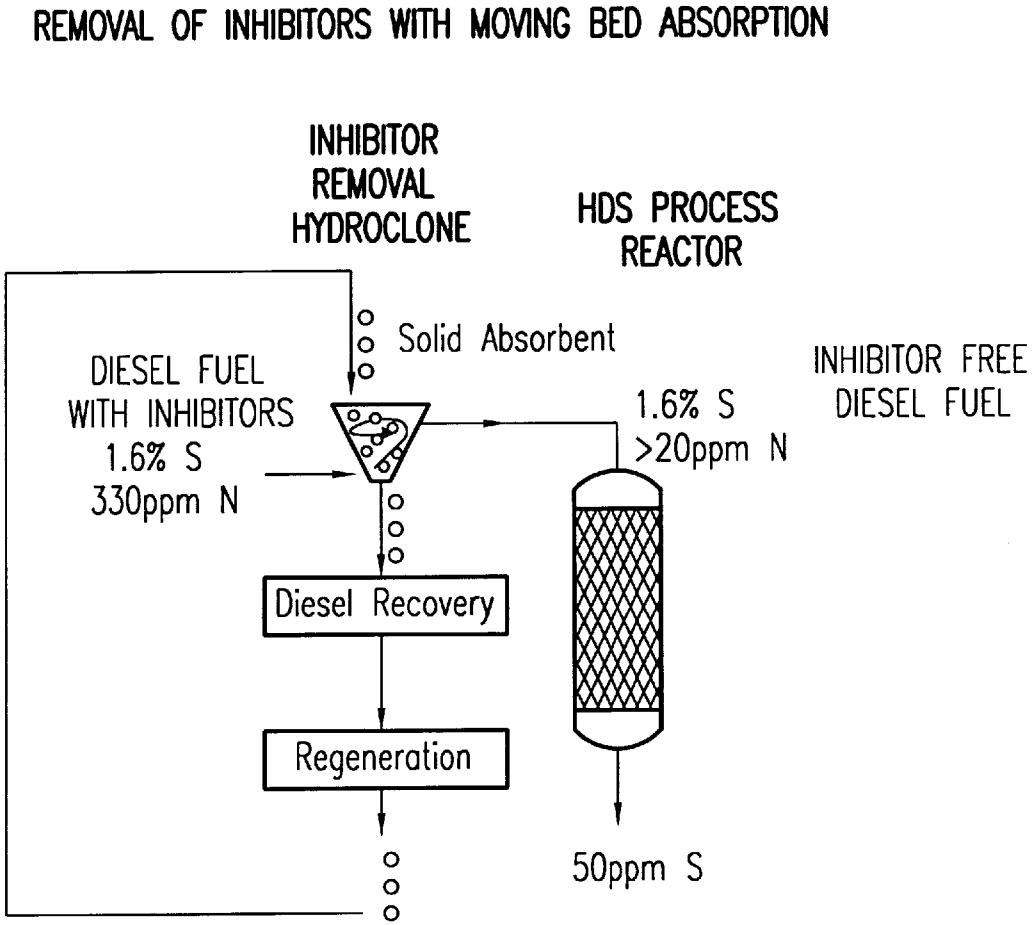

Another embodiment of this invention is shown in FIG. 10, where the adsorbent and fuel to be treated are contacted in a conical circulating vessel, such as a hydroclone. Such types of vessels are highly effective in separating solids and liquids at high throughputs. In such a process, the critical features include contact times between the solid and liquid sufficient to achieve the desired level of inhibitor reduction, and flow velocities for liquid and solid which can achieve separation of liquid and solid without carryover of solid into the liquid exit stream. It is within the scope of this invention to conduct such adsorption processes at room temperature, at elevated temperatures or sub-ambient temperatures, depending on the nature of the adsorbent, the nature of the fuel that is being treated and the desired result of the treatment. Anyone expert in this area can easily determine the optimal conditions by experimental studies.

Suitable Solid Adsorbents

As will be shown in the examples, the choice of a suitable solid adsorbent for inhibitors is the key to the success of this combined process. We have found that many porous solids, when contacted with diesel fuel feeds, can provide some benefit to the HDS of refractory sulphur compounds (RS-compounds). However, the solid adsorbents of choice should not only have the capability of removing inhibitors, but they should be highly selective in this removal and should have capacities for removing substantial amounts of inhibitors before they are no longer effective. Once the inhibitors have been adsorbed, the adsorbent should have the properties that allow the recovery of physically adsorbed inhibitor free fuel, while strongly retaining the adsorbed inhibitors. In addition, the preferred solid adsorbents should have the durability to withstand regeneration in a process in which the adsorbed inhibitors are burned off of the adsorbent without losing their effectiveness in multiple cycles of adsorption/regeneration.

It is possible to remove inhibitors using organic solid adsorbents, and the use of such materials falls within the scope of this invention. However, regeneration of such materials is more complicated than for inorganic solids as combustion is not a viable option. Suitable solids include porous carbons and intrinsically porous ion-exchange resins (so-called macroreticular resins). As will be shown in the examples, both strongly acidic and strongly basic ion-exchange resins adsorb some inhibitors from diesel fuel feeds, and such treatments of diesel fuel feeds allows a higher degree of HDS of RS-compounds than is possible for untreated diesel fuel feeds. However, regeneration of the ion-exchange resins, to restore their original capacity for inhibitor removal, requires large volumes of reagent liquids (e.g. aqueous or alcoholic acids and bases) to remove the chemically adsorbed diesel fuel components and restore the active sites within the ion-exchange resin. Carbon adsorbents have similar disadvantages in that they are not highly selective for only the inhibitors and they cannot be regenerated by burning.

Another class of materials, which has been found to be effective for the combined process of this invention, is porous strongly basic alkaline earth oxide containing materials. Examples of such materials include carefully calcined magnesium hydroxy carbonates and porous Portland cements. These materials have the additional advantage that they can function as oxidation catalysts, which allows the use of lower temperatures in the regeneration step.

The most effective solids, which have been identified for this application, are acidic silica/alumina containing materials having surface areas greater than 100 $m^2/g$. Such materials include pure silica/aluminas produced by co-precipitating silica and alumina from a variety of precursors as well as composites containing said silica/aluminas in combination with other materials, such as zeolites. The acidity of these adsorbents can be conveniently measured by the well-known "alpha" test as described by Weisz and Miale, J. Catal. 4, 527 (1965). This test measures a solid's ability to crack hexane at atmospheric pressure and 538° C. Normal silica/aluminas containing about 4% aluminum have alpha values of 1, whereas composites containing zeolites can have alpha values exceeding 100. For the purposes of the present invention, it is preferable to utilize solid adsorbents having alpha values of from 0.5 to 10 and most preferred from 1–5. Such materials are often used as catalyst supports or as composite catalysts. They are highly durable and may be regenerated many times without losing effectiveness in the application of the present invention. This is especially true for FCC cracking catalysts in which the binder or matrix (silica/alumina) comprises about 60% of the composite and an acidic zeolite comprises the rest of the composite. The acidity of such composites can be improved by impregnation of or co-precipitation of the silica/alumina with phosphorus containing acids prior to the final calcination step as described in U.S. Pat. Nos 3,962,364, 4,044,065, 4,454,241 and 5,481,057. Such phosphorus treated silica/alumina containing composites are also preferred materials in the present invention.

EXAMPLES

Example 1

In order to evaluate the effect of removing inhibitors from diesel fuels prior to the hydrotreating process, a series of experiments were conducted, in which a standard diesel fuel was contacted in various ways with several solid adsorbents, and the treated and untreated feeds were subsequently desulphurized under standard conditions. The composition of the diesel fuel feed is given in Table 1.

TABLE 1

| | Composition of Standard Diesel Fuels | | | | | | | | | |
|---|---|---|---|---|---|---|---|---|---|---|
| | | ppm | PPM | | | % Aromatics | | | | |
| | | 4MDBT | 46DMDBT | ppm N | % H | S.G. | Mono | Di | Tri | Total |
| A | 1.5990 | 330 | 160 | 293 | 12.3 | 0.8733 | 13.02 | 14.84 | 5.22 | 33.08 |
| B | 1.6050 | 291 | 142 | 327 | | 0.8742 | | | | |

Diesel fuel B was percolated through a dry column of activated chromatographic grade silica gel. In trial tests it was found that all of the N-compounds, some of the S-compounds and some of the aromatics were removed from the diesel fuel passing through the silica gel column for the first two equivalent bed volumes of diesel fuel, which were percolated. The next three equivalent bed volumes of eluted diesel fuel contained essentially no N-compounds, and the S-compounds and aromatics eluted at the same concentration as in the parent feed. In the next four bed volumes of eluted diesel fuel, it was observed that 54 ppm of N had eluted. Thus, it took about two bed volumes of diesel fuel to come to equilibrium with the silica gel column in terms of S-compounds and aromatics. The capacity of this silica gel for selectively removing N-compounds and leaving the S-compounds and aromatics in their original concentration was about three bed volumes of diesel eluting through the column after the column came to equilibrium with the diesel fuel. Thus, it is important not to exceed the capacity of the adsorbent for removing inhibitors from the diesel fuel in the adsorbent step of this combined process.

Using a similar procedure, 16 liters of diesel fuel were prepared in which the N-compounds and other polar inhibitors were removed from the diesel fuel, but the S-compounds and aromatic hydrocarbons were present in approximately their original concentrations. The nitrogen content of the above treated "inhibitor free fuel" was found to be about 7 ppm. This treated diesel fuel will be referred to as inhibitor free diesel fuel 1C. Thus, the above treatment removed over 97% of all of the N-containing inhibitors in the diesel fuel. The aromatic hydrocarbons and sulphur level of this inhibitor free fuel were found to be essentially the same as that of the untreated diesel fuel, and the distribution and content of RS-compounds was also the same as those of the untreated diesel fuel. This "inhibitor free fuel" was then used for hydrotreating studies to demonstrate how the reactivity of RS-compounds is greatly improved by removing inhibitors in a pretreating step.

Example 2

The effectiveness of different liquid adsorbents for removing inhibitors from diesel fuels were determined by contacting diesel fuel A of Example 1 and various liquid adsorbents using a variety of procedures as described in Table 2. The effectiveness was evaluated by determining the amount of N-compounds removed from the diesel fuel and the non-selective loss of diesel fuel to the adsorbent liquid. As can be seen from the table, liquids like acetone, and toluene are not effective as they completely dissolve the diesel fuel, and there is no phase separation. Liquids such as water give good phase separation, but do not extract the inhibitors. Liquids, having just the right solvent parameters such as dimethylformamide, selectively remove inhibitors, which gives a high yield of treated diesel fuel. The table also shows that azeotropic mixtures are effective adsorbents, but that some azeotropes are more effective than others-e.g. i-propyl alcohol/water azeotrope contains too little water, which results in an excessive solubility of diesel fuel in the azeotropic mixture, and gives a low yield of treated diesel fuel. By contrast, n-propyl alcohol/water azeotrope contains the right amount of water, which provides high selectivity for inhibitors with excellent yields of treated diesel fuel product. Also shown in the table are comparisons of conventional caustic extraction of the diesel fuel in an attempt to selectively remove acidic inhibitors. This extraction also produced an emulsion that was difficult to break. The amount of material extracted was very little, and the level of nitrogen in the treated fuel was not lowered significantly.

TABLE 2

Adsorption of Inhibitors by Liquid Adsorbents

| | Liquid Adsorbent | Treatment Method | Nitrogen Content: * Extracted Oil | Nitrogen Content: Extract | % of Oil Lost to Absorption Liquid |
|---|---|---|---|---|---|
| A | Dimethyl Formamide | Single Extraction | 212 | 3881 | 4.0 |
| B | MeOH/H2O (25%) | Three Extractions | 135 | 20000 | 0.8 |
| C | MeOH/H2O (25%) | PREP 4ext 3.5/1.5 | 237 | | |
| D | n-PrOH/H2O (28%) | Single Extraction | | | 1.3 |
| E | i-PrOH/H2O (13%) | Single Extraction | | 968 | |
| F | MeOH (trace H2O) | Continuous L/L Extn | 213 | | |
| G | i-PrOH/H2O (13%) | Continuous L/L Extn | | | 23 |
| H | i-PrOH/H2O (28%) | Continuous L/L Extn | | 3103 | 5.0 |
| I | Acetone | Single Extraction | (No Phase Separation) | | |
| J | Toluene | Single Extraction | (No Phase Separation) | | |
| K | Water | Single Extraction | >290 | No Extract) | |
| | Caustic Extractions | | | | |
| I | Aqueous 2N NaOH | Single Extraction | 286 | 1522 | 0.1 |
| J | 75MeOH/25H2O NaOH | Single Extraction | 259 | 2512 | 0.9 |

Example 3

Adsorption of Inhibitors from Diesel Fuel A with Solid Adsorbents.

To demonstrate the effectiveness of a variety of solid adsorbents for removing inhibitors from diesel fuels before hydrotreating, the diesel fuel A of Example 1 was contacted with selected solid adsorbents at a ratio of 10 parts diesel fuel to 0.5 parts of solid adsorbent. The original inhibitor contents of the diesel fuel were estimated in three ways; total nitrogen content=293 ppm; the total content of carbazoles=41.4 ppmN (estimated by GC/AED); and the content of one specific inhibitor, 1-methylcarbazole (1 MCARB)=2.7 ppmN. These same indicators were measured after contact of the diesel fuel with the solid at room temperature for 5–10 hr. It should be noted that these treatments did not substantially affect the concentration of RS-compounds or aromatic hydrocarbons in the treated diesel fuel, but selectively removed the polar inhibitors. The results summarized below in Table 3 show the following. Many porous solid inorganic oxides remove inhibitors from the diesel fuel. Both acidic adsorbents (C and D) and basic adsorbents (F, H, J and K) are effective in removing inhibitors. To demonstrate the need for high porosity in the adsorbent, examples E and F show that a basic solid with no porosity, such as crystalline powdered magnesium hydroxy carbonate, is not highly effective, but if it is calcined at 450° C. to decompose the carbonate and generate porosity, an effective adsorbent can be produced. The Examples N, O and P show that carbons are also effective adsorbents and further that their effectiveness can be affected by pretreatment conditions. It can be seen that Diahope (a commercially available carbon) has superior adsorbent properties, if it is calcined in air rather than in inert atmosphere. Microcrystalline basic silicates and mixed oxides (Example J) as well as natural minerals (Examples L and M) can also be used in this adsorption step.

TABLE 3

Effectivenes of Different Solid Adsorbents for Removing Inhibitors

| | SOLID ADSORBENTS | % Inhibitor Removal Total Nitrogen | Carbazoles | 1MCARB |
|---|---|---|---|---|
| A | Alumina | 28.7 | | |
| B | Silica | 36.9 | | |
| C | Silica/Alumina A | 33.4 | | |
| D | Silica/Alumina B | 27.3 | | |
| E | 4MgCO3Mg(OH)2.5H2O | 5.8 | | |
| F | 4MgCO3Mg(OH)2.5H2O Calc. 450° C. | 40.4 | 52.4 | 59.1 |
| G | Ca(OH)2 | | 5.7 | 22.7 |
| H | Zn(OH)2 | | 6.3 | 16.0 |
| I | ZrO2 | | 12.4 | 27.1 |
| J | Gray Cement (as rec) | | 17.8 | 34.3 |
| K | AMB-A27 | | 71.8 | 82.8 |
| L | Florosil | | | 12.3 |
| M | Talc | | 41.0 | 45.7 |
| N | Diahope (450° C./Air) | 47.4 | | |
| O | Diahope (450° C./N2) | 27.6 | | |
| P | Carbosorb | | 9.1 | 24.8 |

Example 4

To demonstrate that the conditions used for preparing the adsorbent prior to use in the adsorbent step are important and to show that the ratio of adsorbent to diesel fuel is important, a series of experiments were conducted in which adsorbents were prepared by calcining magnesium hydroxy carbonate at different temperatures in air for 2 hr and then contacting the adsorbent and diesel fuel in different ratios at room temperature overnight. In all cases, 10 weight units of diesel fuel were treated with the weights of adsorbents shown in Table 4. These results indicate that it is important for the adsorbent to have a high surface area, and if the level of inhibitors in the diesel fuel is to be lowered to less than 100 ppmN, then surface areas of at least 100 $m^2$/gr are required for this adsorbent. Other work indicates that for other adsorbents, it is also important for the adsorbent to have at least 100 $m^2$/gr surface area. The data of Table 4 show also that for any given adsorbent, there is a capacity limitation to its ability to remove inhibitors from diesel fuel. For this specific adsorbent, a ratio of 1 part adsorbent to 10 parts diesel fuel was necessary to lower the nitrogen level of the treated diesel fuel to less than 100 ppm N. Thus, for any adsorbent that is to be considered for the combined process of the present invention, it is necessary to establish the relative amounts of adsorbent used to diesel fuel treated in order to achieve levels of inhibitors of less than 200 ppmN in the treated diesel fuel. In subsequent examples, we will show that the levels of inhibitors in treated diesel fuels should be less than 200 ppmN for an effective process, and that it is even more desirable to lower the level of inhibitors in the treated diesel fuel to less than 100 ppmN. As is also shown by the data of Table 4, the preparation method for the adsorbent is critical for the specific adsorbent of this example. If the temperature of preparation is too high, the surface area becomes low, and the effectiveness of the adsorbent declines. This is particularly important when one considers that the overall process requires that the adsorbent be reused in a cyclic process. Thus, if the adsorbent becomes saturated with inhibitor, it must be regenerated and then used again for adsorption of inhibitors from additional diesel fuel. If this regeneration is accomplished by combustion, then the temperature must be controlled in such a way that surface area is not lost during combustion of the adsorbed inhibitors. Fortunately, in this specific example, the adsorbent contains alkaline earth ions which catalyze combustion, and the temperature necessary for complete removal of the inhibitors is lowered to a range in which surface area is not lost during regeneration.

TABLE 4

Importance of Surface Area and Diesel/Adsorbent Ratio

| | Calcination Temp. (C) | Surface Area m2/gr | Adsorbent weight | Product ppm N | Percent Removed |
|---|---|---|---|---|---|
| A | none | ~1 | 0.5 | 276 | 5.8 |
| B | 450 | 149 | 0.5 | 170 | 40.4 |
| C | 450 | 149 | 1 | 92 | 67.7 |
| D | 450 | 149 | 2 | 49 | 82.8 |
| E | 550 | 88 | 1 | 182 | 36.1 |
| F | 550 | 88 | 2 | 119 | 58.2 |

Example 5

Use of Commercial Cracking Catalysts for Adsorption of Inhibitors.

In some instances, it may be desired to integrate the adsorption step of this combined process with another process in a refinery in order to minimize the costs of equipment construction. Such integrated processes can also take advantage of the availability of very rugged inexpensive materials, which have been designed for severe process applications, including processes in which the solid experiences high temperature swings without loss of physical integrity. One example of this was described in FIG. 9. In this example, a small portion of the equilibrium catalyst circulating in an FCC process is taken out as a side stream and used as the adsorbent in the first stage of the combined process of the present invention. The adsorbent, which becomes saturated with inhibitors, is then recycled back to the stripper section of the FCC process, where adsorbed inhibitor free diesel fuel is recovered, and the FCC catalyst containing adsorbed inhibitors is then burned in the FCC regenerator. Other examples of combined processes can include the use of fixed bed hydrocracking processes, where the catalyst must be periodically regenerated by combustion of coke on catalyst. Such catalysts are also useful for the process of the present invention. To demonstrate the ability of such commercial catalysts to perform as adsorbents in the first stage of the combined process of the present invention, several catalysts were contacted with the diesel fuels of Example 1, and the amount of the inhibitors adsorbed by these catalysts was determined. The results of these studies are summarized here.

A) A freshly prepared commercial FCC containing 40% rare earth Y-zeolite catalyst was contacted with diesel fuel A in a ratio of 0.5/10 adsorbent to diesel fuel for 10 hr at room temperature. The treated diesel fuel was then analyzed, and it was found that the inhibitor level had been lowered by 8.5%.

B) The commercial FCC catalyst of Example 5A was used in an FCC cracking process, and when the catalyst composition had reached steady state (equilibrium catalyst), a sample was withdrawn and subsequently used as an adsorbent for inhibitors in diesel fuel. This equilibrium catalyst was contacted with diesel fuel A in a ratio of 0.5/10 adsorbent to diesel fuel for 10 hr at room temperature. The treated diesel fuel was then analyzed, and it was found that the inhibitor level had been lowered by 6.3%. Another portion of this equilibrium FCC catalyst was contacted with diesel fuel at an adsorbent to diesel fuel ratio of 2/10.

Analysis of this treated diesel fuel showed that the inhibitors had been lowered by 31%. Similarly, another portion of this equilibrium FCC catalyst when contacted with diesel fuel at an adsorbent to diesel fuel ratio of 4/10 lowered the inhibitor level by 46%.

C) A commercial hydrocracking carrier containing 10% y-zeolite and 90% alumina was used as an adsorbent for the inhibitors in diesel fuel. The alpha value (hexane cracking activity at 500° C.) of this material was about 100. This material was contacted with diesel fuel 1A in a ratio of 0.5/10 adsorbent to diesel fuel for 10 hr at room temperature. The treated diesel fuel was then analyzed and it was found that the inhibitor level had been lowered by 27%.

Example 6

Preparation of Feeds for HDS of Diesel Fuels Containing Reduced Inhibitor Levels.

In order to demonstrate the improvement in processability of diesel fuels using the combined processes of the present invention, the diesel fuels of Example 1 were treated with several adsorbents in different ways to lower the inhibitor levels of the diesel fuels prior to hydroprocessing. The adsorbents used in this first step of our combined process and the resultant treated diesel fuels containing a lower level of inhibitors consisted of the following:

a) Inhibitors removed by a liquid adsorbent in a liquid/liquid extraction process;

b) Inhibitors removed by an acid ion-exchange resin in a batch contact process;

c) Inhibitors removed by a base ion-exchange resin in a chromatographic process;

d) Inhibitors removed by a porous basic inorganic solid in a batch contact process;

e) Inhibitors removed by an acidic catalytic cracking catalyst in a batch contact process;

f) Inhibitors removed by an acidic hydrocracking catalyst in a batch contact process.

A) The diesel fuel of Example 1B was extracted 4 times with a 75/25 mixture of methanol and water at room temperature. The relative volumes of diesel fuel to adsorbent were 2.3/1. Analysis of the treated diesel fuel showed that this process removed 26% of the inhibitors.

B) The diesel fuel of Example 1B was contacted at room temperature in a stirred vessel overnight with a strong acid ion-exchange resin (Amberlyst-15 in protonic form). The volume of diesel fuel treated was 3 volumes of diesel fuel per volume of ion-exchange resin. The ion-exchange resin was removed by filtration, and an analysis of the treated diesel fuel showed that this process removed 39% of the inhibitors.

C) The diesel fuel of Example 1B was percolated at room temperature through a fixed bed of a strong base ion-exchange resin (Amberlyst-A27 in the hydroxide form), so that the total volume of diesel fuel treated was 2.4 volumes of diesel fuel per volume of ion-exchange resin. Analysis of the treated diesel fuel showed that this process removed 76% of the inhibitors.

D) The diesel fuel of Example 1B was contacted at room temperature overnight with a porous strong base inorganic solid (calcined magnesium hydroxy carbonate). The volume of diesel fuel treated was 10 parts by weight of diesel fuel per 1 part by weight of the adsorbent. The solids were removed by filtration, and the process was repeated a second time. Analysis of the treated diesel fuel showed that this process removed 76% of the inhibitors.

E) The diesel fuel of Example 1B was contacted at room temperature overnight with a commercial equilibrium FCC catalyst (containing 40% rare earth Y-zeolite). The volume of diesel fuel treated was 4.8 parts by weight of diesel fuel per 1 part by weight of the adsorbent. The solids were removed by filtration. Analysis of the treated diesel fuel showed that this process removed 39% of the inhibitors.

F) The diesel fuel of Example 1B was contacted at room temperature over a weekend with a commercial silica alumina cracking catalyst base. The volume of diesel fuel treated was 2.7 parts by weight of diesel fuel per 1 part by weight of the adsorbent. The solids were removed by filtration. Analysis of the treated diesel fuel showed that this process removed 94% of the inhibitors.

Example 7

Hydrotreatment of Diesel Fuels Having Reduced Inhibitor Contents.

The treated diesel fuels of Examples 1 and 6 as well as the parent untreated diesel fuel of Example 1B were hydrotreated in a fixed bed downflow reactor containing a commercial hydrotreating catalyst composed of mixed nickel and molybdenum sulphides supported on alumina. The feed compositions are summarized in Table 5. Several reaction conditions were used and these are summarized together with the results of the hydrotreating studies in Table 6. The hydrogen to hydrocarbon ratios in all tests were 500/1 (N1/1). These results show that in all cases, prior treatment of the diesel fuel with a selective adsorbent results in dramatic improvements in the subsequent hydrotreating process. This is particularly true for the RS-compounds, where in all feeds (treated and untreated) the initial level of RS-compounds were found to be 750–800 ppmS.

Thus, to reach a level of 100 or 50 ppmS in the final product, the RS-compound conversions must be 87 and 93%, which is extremely difficult to achieve without the use of the combined process of the present invention.

The data also show that the total N level in the treated feed is not an accurate indicator of the hydroprocess ability of the adsorbent treated diesel fuel. To illustrate this, the adsorbent treated feeds of Examples 7D, 7G and 7H all showed approximately the same benefit in hydroprocess ability compared with the untreated case (Example 7B), even though the adsorbent treatments resulted in different levels of total nitrogen in the treated products. These data show that adsorbents, which are acidic in nature (for example 7D, 7H and 7I) are highly effective in removing the strongest inhibitors in the diesel fuel. In addition, the data show that if the level of total nitrogen is reduced to less than 100 ppmN and especially to a level of about 20 ppmN, the adsorbent treated feed can easily be hydroprocessed to produce a product which contains less than 50 ppms (Examples 7Q and 7R). Also shown in the examples is the fact that with the combined process of the present invention, it is possible to produce diesel fuels which contain less than 10 ppm total nitrogen.

TABLE 5

FEED COMPOSITIONS

| | Treatment | ppmS | ppm N |
|---|---|---|---|
| Example 1A | Untreated | 15990 | 293.0 |
| Example 1B | Untreated | 16050 | 327.0 |
| Example 6A | MeOH/H2O | 16030 | 237.0 |

TABLE 5-continued

| FEED COMPOSITIONS | | | |
|---|---|---|---|
| | Treatment | ppmS | ppm N |
| Example 6B | AMB-15 | 15780 | 205.0 |
| Example 6C | AMB-A27 | 15870 | 80.0 |
| Example 6D | MgOx | 16080 | 80.0 |
| Example 6E | FCC | 15700 | 201.0 |
| Example 6F | HCB-130x | 13970 | 21.0 |
| Example 1C | SiO2 | 14580 | 6.3 |

each compound was added in such an amount that the level of nitrogen in the inhibitor free diesel fuel was increased by 300 ppmN. The untreated diesel fuel contained 327 ppmN. The three compounds used in this study represent three of the major classes of N-compounds, which were identified in the diesel fuel. Indoles and carbazoles are acidic and acridine is basic. Thus, an acidic adsorbent should have a higher preference for adsorbing basic compounds, such as acridine, while basic adsorbents should have a higher preference for adsorbing acidic N-compounds, such as indoles and carbazoles. Both acidic and basic N-compounds are adsorbed by adsorbents having highly polar surfaces, and there is a

TABLE 6

| HYDROTRATING CONDITIONS AND PRODUCT COMPOSITIONS | | | | | | | |
|---|---|---|---|---|---|---|---|
| | | Temp. | Pressure | | Product Composition | | % RS-Compound |
| Example 7 | Treatment | (C.) | atm (H2) | LHSV | ppm S | ppm N | Removed |
| A | Untreated | 328 | 30 | 1.64 | 1034 | 79.0 | 46.2 |
| B | Untreated | 328 | 30 | 1.54 | 648 | 34.0 | 57.0 |
| C | MeOH/H2O | 328 | 30 | 1.50 | 505 | 24.0 | 64.6 |
| D | AMB-15 | 328 | 30 | 1.55 | 290 | 11.0 | 72.1 |
| E | AMB-A27 | 328 | 30 | 1.51 | 412 | 11.0 | 67.8 |
| F | MgOx | 328 | 30 | 1.69 | 350 | 6.7 | 70.0 |
| G | MgOx | 328 | 30 | 1.51 | 303 | 6.0 | 74.0 |
| H | FCC | 328 | 30 | 1.52 | 267 | 9.0 | 72.9 |
| I | HCB-130x | 328 | 30 | 1.63 | 78 | 2.4 | 89.6 |
| J | SiO2 | 328 | 30 | 1.69 | 96 | 2.8 | 87.1 |
| K | Untreated | 340 | 30 | 1.45 | 339 | 58.0 | 70.4 |
| L | MeOH/H2O | 340 | 30 | 1.49 | 188 | 17.0 | 75.6 |
| M | AMB-15 | 340 | 30 | 1.51 | 113 | 7.4 | 84.9 |
| N | AMB-A27 | 340 | 30 | 1.53 | 173 | 8.0 | 76.8 |
| O | MgOx | 340 | 30 | 1.47 | 117 | 4.4 | 84.3 |
| P | FCC | 340 | 30 | 1.55 | 110 | 7.0 | 85.3 |
| Q | HCB-130x | 340 | 30 | 1.43 | 41 | 2.6 | 94.5 |
| R | SiO2 | 340 | 30 | 1.47 | 46 | 2.5 | 93.8 |

Example 8

Demonstration of the Effect of Inhibitors on Hydroprocessability.

To demonstrate that the treatments in Examples 1–7 truly accomplished a selective removal of inhibitors from the diesel fuel rather than causing some other change in the diesel fuel composition, such as altering the sulphur compounds or aromatic hydrocarbons in the fuel, a series of experiments were conducted, in which specific N-compounds were added back to the inhibitor free diesel fuel of Example 1C. The N-compounds, which were added back, included 3-methylindole (3 MIND), 1,4-dimethylcarbazole (14 DMCB) and acridine (ACRD), and higher preference for adsorption of polyaromatic ring N-compounds over single or double ring aromatic N-compounds. The results of these studies are shown in Table 7. The results show clearly that all three of the N-compound additives caused the level of desulphurization of the diesel fuel to decrease and that the basic additive, acridine, caused the greatest inhibition. The lighter acidic additive (3-methylindole) caused the smallest inhibition. Comparing these results with those of Example 7 shows that adsorbents, which are selective for the removal of basic N-compounds, will give the greatest benefit in the combined process of the present invention. Such adsorbents are acidic in nature as in Examples 7D, 7H and 7I.

TABLE 7

| EFFECTS OF SPECIFIC INHIBITORS ON HYDROTREATING | | | | | | | | |
|---|---|---|---|---|---|---|---|---|
| | | | Temp. | Pressure | | Product Composition | | % RS-Compounds |
| Example | Treatment | Additive | (C.) | atm (H2) | LHSV | ppm S | ppm N | Removed |
| A | Untreated | None | 328 | 30 | 1.46 | 1034 | 79.0 | 46.2 |
| B | SiO2 | None | 328 | 30 | 1.47 | 93 | 2.1 | 87.5 |
| C | SiO2 | 3MIND | 328 | 30 | 1.46 | 179 | 2.8 | 76.0 |
| D | SiO2 | 14DMCB | 328 | 30 | 1.46 | 217 | 5.8 | 71.0 |
| E | SiO2 | ACRD | 328 | 30 | 1.46 | 1070 | 11.0 | 45.0 |

Example 9

For an adsorbent to be useful in our invention, it must perform several functions. Firstly, it must selectively adsorb the inhibitors from the oil; secondly, it must be regenerable without causing any significant yield losses of any valuable oil that may be physically adsorbed within the pores of the adsorbent; and thirdly, the adsorbent must selectively retain the inhibitors during the stripping step of the regeneration—prior to combustion to restore the original adsorption capacity of the adsorbent. Thus, some adsorbents may have good adsorption capacities for inhibitors, but may not be able to retain the inhibitors during the stripping step. Other adsorbents may have good inhibitor retention properties, but may be too active and may induce cracking of valuable oils during the stripping step. To illustrate such problems, the following experiments were conducted. The diesel fuel of Example 1B was treated with three different adsorbents (Examples 1C, 6E and 6F) to remove inhibitors from the diesel fuel. The resultant adsorbents, containing both removed inhibitors and physically adsorbed diesel fuel, were heated in the presence of a stripping gas at elevated temperature to remove the adsorbed diesel fuels, while selectively retaining the adsorbed inhibitors. In these experiments, the ratio of diesel fuel to adsorbent was 10/1, and the adsorbents containing both strongly adsorbed inhibitors and physically adsorbed diesel fuel were isolated by filtration. The stripping operation consisted of placing the recovered adsorbent, containing the adsorbed inhibitors and diesel fuels, in a tubular furnace and programming the furnace temperature from room temperature to 450° C., while flowing $N_2$ gas through the furnace. Diesel fuels, which were removed from the adsorbent, were collected in a cooled trap, and any light cracked products were allowed to escape. The yields of recovered treated diesel fuels, compositions of the treated oils, yields of stripped diesel fuels and the composition of stripped diesel fuels are summarized in Table 8.

TABLE 8

| | Treatment of Diesel Fuel with Adsorbent and Adsorbent Regeneration | | | | | | | | | | |
|---|---|---|---|---|---|---|---|---|---|---|---|
| | Oil recovered by filtration | | | Oil adsorbed by solid | | | Oil recovered by stripping solid | | | Diesel loss | Calcd % of |
| Absorbent | % of total amount of oil contacted with solid | % S | ppm N | % of total amount of oil contacted with solid | Calcd % S | Calcd ppm N | % of amount of adsorbed oil | % S | ppm N | due to cracking; % of amount of adsorbed oil | nitrogen retained in solid during stripping step |
| None | | 1.60 | 327 | | | | | | | | |
| Silica gel | 93 | 1.51 | 107 | 7 | 2.75 | 3140 | 100 | 2.04 | 2000 | 0 | 36 |
| Equil FCC | 96 | 1.56 | 195 | 4 | 2.61 | 3670 | 100 | 2.05 | 1000 | 0 | 73 |
| HDC Base | 94 | 1.54 | 53 | 6 | 2.50 | 4470 | 33 | n.a. | 2500 | 67 | 81 |

It can be seen that all of the adsorbents are effective in selectively removing inhibitors from the diesel fuel. The HDC base has good retention of inhibitors in the stripping operation, but induces excessive cracking of valuable diesel fuel during the stripping step. By contrast, silica gel has low retention of inhibitors in the stripping step but does not induce cracking. The most preferred adsorbent is equilibrium FCC catalyst, which did not induce cracking during the stripping step, while retaining the inhibitors. The alpha values, as measured in the standard hexane cracking test, of the three adsorbents were ~0 for silica gel, about 1 for the equilibrium FCC catalyst and about 100 for the hydrocracking catalyst base (HCB-130x). Thus, it can be seen that the most preferred adsorbents should have an intermediate alpha activity of 0.3 to 10.

What is claimed is:

1. A combined process for improved hydrotreating of diesel fuels, which comprises the following steps:

(a) contact of the fuel to be hydrotreated with a selective solid adsorbent to remove inhibiting compounds from the fuel, the adsorbent having an acid activity, as measured by the standard hexane cracking test, —alpha test—, which falls in the range of 0.3 to 10 alpha, the adsorbent including an equilibrium FCC catalyst;

(b) separation of the adsorbent, containing the inhibitors, from the fuel with a reduced inhibitor level without significant loss of the fuel;

(c) regeneration of the adsorbent and recycle of the regenerated adsorbent back to the adsorption zone; and (d) hydrotreating the fuel with a reduced inhibitor level to produce a clean diesel fuel.

2. The process of claim 1, in which the adsorbent is selected from the group consisting of a liquid or a solid.

3. The process of claim 1, in which the fuel being treated includes a liquid phase.

4. The process of claim 1, in which the fuel being treated includes a vapor phase.

5. A combined process for improved hydrotreating of diesel fuels, which comprises the following steps:

(a) contact of the fuel to be hydrotreated with a selective adsorbent to remove inhibiting compounds from the fuel;

(b) separation of the adsorbent, containing the inhibitors, from the fuel with a reduced inhibitor level without significant loss of the fuel;

(c) regeneration of the adsorbent and recycle of the regenerated adsorbent back to the adsorption zone; and (d) hydrotreating the fuel with a reduced inhibitor level to produce a clean diesel fuel, wherein the adsorbent includes a solid catalyst that is circulating within a catalytic refinery process in close proximity to the process of steps (a)–(d) and circulating solid catalyst is diverted to the adsorption zone, and the solid catalyst, which adsorbs the inhibitors, is separated from the treated fuel and is returned to the catalytic refinery process at a point, where any remaining treated fuel can be recovered, and the solid catalyst is then passed on to the regeneration zone of the catalytic refinery process.

6. The process of claim 5, in which the adsorbent is a solid, which is basic in nature.

7. The process of claim 5, in which the adsorbent is a solid, which is acidic in nature.

8. The process of claim 5, in which the acidic solid adsorbent has an acid activity, as measured by the standard hexane cracking test, —alpha test—, which falls in the range of 0.3 to 10 alpha.

9. The process of claim 5, in which the acidic solid adsorbent includes an equilibrium FCC catalyst.

10. The process of claim 5, in which a sulphur content of the fuel has been reduced from at least 500 ppm total sulphur to produce the clean diesel fuel having a sulphur content of less than 500 ppm total sulphur.

11. A combined process for improved hydrotreating of diesel fuels, which comprises the following steps:

(a) contact of the fuel to be hydrotreated with a selective liquid adsorbent having solvent parameters which fall within the desired area defined in FIG. 4, to remove inhibiting compounds from the fuel;

(b) separation of the adsorbent, containing the inhibitors, from the fuel with a reduced inhibitor level without significant loss of the fuel;

(c) regeneration of the adsorbent and recycle of the regenerated adsorbent back to the adsorption zone; and (d) hydrotreating the fuel with a reduced inhibitor level to produce a clean diesel fuel.

12. The process of claim 11, in which a sulphur content of the fuel has been reduced from at least 500 ppm total sulphur to produce the clean diesel fuel having a sulphur content of less than 500 ppm total sulphur.

* * * * *